US010519662B2

(12) United States Patent
Jordan

(10) Patent No.: US 10,519,662 B2
(45) Date of Patent: Dec. 31, 2019

(54) METAL ROOF PANEL WITH DEFORMATION RESISTANT RIB AND METHOD OF MAKING THE SAME

(71) Applicant: Daniel Lawrence Jordan, Burgaw, NC (US)

(72) Inventor: Daniel Lawrence Jordan, Burgaw, NC (US)

( * ) Notice: Subject to any disclaimer, the term of this patent is extended or adjusted under 35 U.S.C. 154(b) by 0 days.

(21) Appl. No.: 16/446,826

(22) Filed: Jun. 20, 2019

(65) Prior Publication Data

US 2019/0301162 A1 Oct. 3, 2019

Related U.S. Application Data

(62) Division of application No. 15/833,151, filed on Dec. 6, 2017.

(51) Int. Cl.

| | |
|---|---|
| ***E04D 3/36*** | (2006.01) |
| ***E04D 3/30*** | (2006.01) |
| ***B21D 13/04*** | (2006.01) |
| ***E04C 2/08*** | (2006.01) |
| ***E04C 2/32*** | (2006.01) |
| ***E04D 3/365*** | (2006.01) |
| ***B21B 1/38*** | (2006.01) |

(52) U.S. Cl.

CPC ..... *E04D 3/3606* (2013.01); *B21B 1/38* (2013.01); *B21D 13/045* (2013.01); *E04C 2/08* (2013.01); *E04C 2/322* (2013.01); *E04D 3/30* (2013.01); *E04D 3/3605* (2013.01); *E04D 3/365* (2013.01)

(58) Field of Classification Search

CPC ..... E04D 3/30; E04D 3/3602; E04D 3/3606; E04D 3/3605; E04D 3/365; E04C 2/322

See application file for complete search history.

(56) References Cited

U.S. PATENT DOCUMENTS

| | | | | | |
|---|---|---|---|---|---|
| 2,108,350 | A | * | 2/1938 | Roth | E04D 3/365 52/534 |
| 2,166,064 | A | * | 7/1939 | Waldemar | E04D 3/365 52/521 |
| 2,166,275 | A | * | 7/1939 | Williams | E04D 3/365 52/534 |
| 3,218,773 | A | * | 11/1965 | Heirich | E04C 2/322 52/521 |
| 3,466,831 | A | * | 9/1969 | Lenoir | E04C 2/292 52/521 |
| 3,520,100 | A | * | 7/1970 | Webb | E04D 3/24 52/534 |
| 3,760,549 | A | * | 9/1973 | Silberkuhl | E04C 2/322 52/630 |

(Continued)

*Primary Examiner* — Jessie T Fonseca

(74) *Attorney, Agent, or Firm* — Carla Gannon Law

(57) ABSTRACT

A metal roof panel includes a rib with a unique shape. The rib is bilateral with upwardly angled sides that each transition into an indentation, with both indentations transitioning into a central flat apex. Between each rib is a channel, preferably including at least one raised surface. The lower surface of the channel between the raised surfaces, and the top of the raised surfaces, are substantially planar and parallel to the flat surface of the apex of the panel. A unique method of manufacturing the roof panel employs a roll machine configured to shape a piece of sheet metal into the roof panel by modifying the shape in many small increments, which allows the final product to have a fairly intricate bend pattern.

4 Claims, 13 Drawing Sheets

(56) References Cited

U.S. PATENT DOCUMENTS

| | | | | | |
|---|---|---|---|---|---|
| 3,990,206 | A * | 11/1976 | Reusser | E04D 3/30 | 52/534 |
| 4,144,369 | A * | 3/1979 | Wass | B32B 3/28 | 428/183 |
| 4,358,916 | A * | 11/1982 | Lacasse | E04C 2/322 | 52/537 |
| 4,554,773 | A * | 11/1985 | Conley | E04D 3/365 | 24/23 W |
| 4,819,398 | A * | 4/1989 | Dameron | E04D 3/24 | 52/522 |
| 5,020,295 | A * | 6/1991 | Haines | E04D 3/30 | 52/630 |
| 8,713,864 | B1 * | 5/2014 | Smith, Jr. | E04D 3/28 | 52/200 |
| 9,951,522 | B2 * | 4/2018 | Chabas | E04D 3/30 | |
| 2003/0029100 | A1 * | 2/2003 | Wetzel, III | E04B 1/34315 | 52/79.1 |
| 2003/0029113 | A1 * | 2/2003 | Wetzel, III | E04B 1/34315 | 52/519 |

* cited by examiner

METAL ROOF PANEL WITH DEFORMATION RESISTANT RIB AND METHOD OF MAKING THE SAME

CROSS-REFERENCE TO RELATED APPLICATIONS

This application is a Divisional Application of United States utility application entitled METAL ROOF PANEL WITH DEFORMATION RESISTANT RIB AND METHOD OF MAKING THE SAME, which was filed on Dec. 6, 2017, and assigned the Ser. No. 15/833,151, issuing as U.S. patent Ser. No. 10/501,938 on Dec. 10, 2019.

BACKGROUND OF THE INVENTION

The present invention relates generally to metal roof panels, and more particularly, to metal roof panels with deformation-resistant ribs, and the method of making the same.

Metal roofs are a popular and practical alternative to conventional shingle roofs, due to their strength and durability, light weight and weather resistance. Metal roof panels can be made from a variety of metals including aluminum, galvanized steel (typically G-60 or G-90 steel), painted or coated steel, and stainless steel, and come in a variety of lengths and gauges. Roof panels typically have a series of elevated ridges (hereinafter "ribs") separated by a series of lower laying "channels". As shown in FIG. 1, panels are arranged on a roof so channels 20 and ribs 30 run substantially parallel to the slope of the roof. This allows water to run off of the roof, primarily along channels 20, in a substantially unimpeded path. As shown in FIG. 1, ribs 30 may have a flattened apex 32. The typical flattened apex is approximately ⅜" wide. Alternatively, ribs 30 may be rounded, as shown in FIG. 2. Peaked apices are also conventional.

Roof panels are typically secured to the roof by screwing the panels onto the underlying substrate, although there is significant debate as to preferred screw placement: rib or channel. As depicted in FIG. 3, a roof panel secured by screw 40 at rib 30 is subjected to considerable "wind sway" or displacement of roof panel relative to underlying substrate 15. This wind sway is increased if screws aren't completely tightened. Unfortunately in an attempt to ensure screws are adequately tightened there is a tendency for installers to overtighten screws, which leads to deformation of the panels, as depicted in FIG. 1. Deformation of panels eventually leads to corrosion, rust, degradation, and failure of the panel.

Deformation of panels at the rib is a common problem because the ribs of conventional roof panels lack adequate structural strength. Said another way, conventional ribs "cave in" easily. This weakness is due to manufacturing limitations. Traditional panels are manufactured using a roll machine which bends metal at room temperature using a number of stations where fixed rollers both guide the metal and make the necessary bends. As the metal travels through the machine, each set of rollers bends the metal a little more than the previous station of rollers. However, these conventional sheet metal fabrication techniques can form only simple ribs with few angles because roof panels become unacceptably distorted during manufacturing when multiple manipulations are attempted. Very simply, introducing too many bends and angles introduces too many conflicting forces on the material, and the end result is a roof panel that is warped with ribs and channels that are not uniform and linear from one end of the panel to the other.

Curved (FIG. 2) and peaked or triangular ribs are fairly structurally strong and resistant to caving in, and can be manufactured using conventional techniques, but don't provide a flat surface against which the screw can lay flush. Said another way, the outer perimeter of screw 40 head isn't in contact with the surface of the rib 30, thereby potentially allowing the ingress of water, which leads to rust, degradation and failure. This is shown in FIG. 2.

The advantages of screwing the roof panel to the substrate at the channel are tainted by the simple fact that the channel is the water path, and water leaks through screw holes. While various implements such as gaskets may delay the entry of water into the screw holes, the inevitable degradation of materials and shifting of roof panels eventually leads to leaking. Leaking leads to corrosion of the roof panel, which leads to degradation, which leads to failure. Leaking also damages the underlying roof substrate and other building structures. For this reason it is also undesirable to screw roof panels to the underlying substrate along the roof panel's channel.

Thus there is a need for a roof panel that can be secured at the rib. It is desirable that this roof panel is strong enough to reasonably withstand wind sway and rib deformation. It is also desirable that the apex of the rib is sized and shaped to allow a standard screw and washer to lay flush. It is also desirable that the screw-apex interface is substantially impervious to water. It is also desirable that the roof panel is mass produced using improved manufacturing methods.

SUMMARY OF THE INVENTION

The present invention pertains to a metal roof panel having a rib with a unique shape. The rib is bilateral with upwardly angled sides that each transition into an indentation, with both indentations transitioning into a central flat apex. The apex is approximately ⅝" wide, and therefore sized and shaped to accommodate a standard screw and washer. Between each rib is a channel, preferably including one or two minor striations, or "raised surfaces" each with a height of approximately ⅛", or approximately 3 mm. The lower surface of the channel between the raised surfaces, and the top of the raised surfaces, are substantially planar and parallel to the flat surface of the apex of the panel.

The present invention also pertains to the method of making the unique metal roof panel. A roll machine is configured to shape a piece of sheet metal into the roof panel by modifying the shape in many small increments, which allows the final product to have a fairly intricate bend pattern.

In use, the roof panel is secured to an underlying roof substrate along the rib. The unique shape of the rib is structurally sound, and particularly resistant to deformation arising from downwardly applied forces such as wind and/or overtightened screws. Because the ribs are so strong it is not necessary to secure the roof panel along the channel, which is likely to lead to water leakage and corrosion.

These and other aspects of the present inventions will become apparent to those skilled in the art after a reading of the following description of the preferred embodiment when considered with the drawings.

DETAILED DESCRIPTION OF THE INVENTION

The following detailed description is of the best currently contemplated modes of carrying out exemplary embodiments of the invention. The description is not to be taken in a limiting sense, but rather it illustrates the general principles of the invention, with the scope of the invention set forth in the appended claims.

The following structure numbers shall apply to the following structures among the various figures:

10—roof panel;
15—substrate;
20—channel;
22—lower surface;
24—raised surface;
30—rib;
32—apex;
34—side;
35—shoulder;
36—indentation;
37—side-apex angle;
38—side-shoulder angle;
39—lower surface-side angle;
40—screw;
45—washer;
50—water;
55—leaked water;
60—sheet metal;
- 60*a*—sheet metal post-first roller;
- 60*b*—sheet metal post-second roller;
- 60*c*—sheet metal post-third roller;
- 60*d*—sheet metal post-forth roller;
- 60*e*—sheet metal post-fifth roller;
- 60*f*—sheet metal post-sixth roller;
- 60*g*—sheet metal post-seventh roller;
- 60*h*—sheet metal post-eighth roller;
- 60*i*—sheet metal post-ninth roller;
- 60*j*—sheet metal post-tenth roller; and
- 60*k*—sheet metal post-eleventh roller;

62—roller set;
- 62*a*—first roller set;
- 62*b*—second roller set;
- 62*c*—third roller set;
- 62*d*—forth roller set;
- 62*e*—fifth roller set;
- 62*f*—sixth roller set;
- 62*g*—seventh roller set;
- 62*h*—eighth roller set;
- 62*i*—ninth roller set;
- 62*j*—tenth roller set; and
- 62*k*—eleventh roller set;

64—controller; and
80—roll machine.

Figure 1:
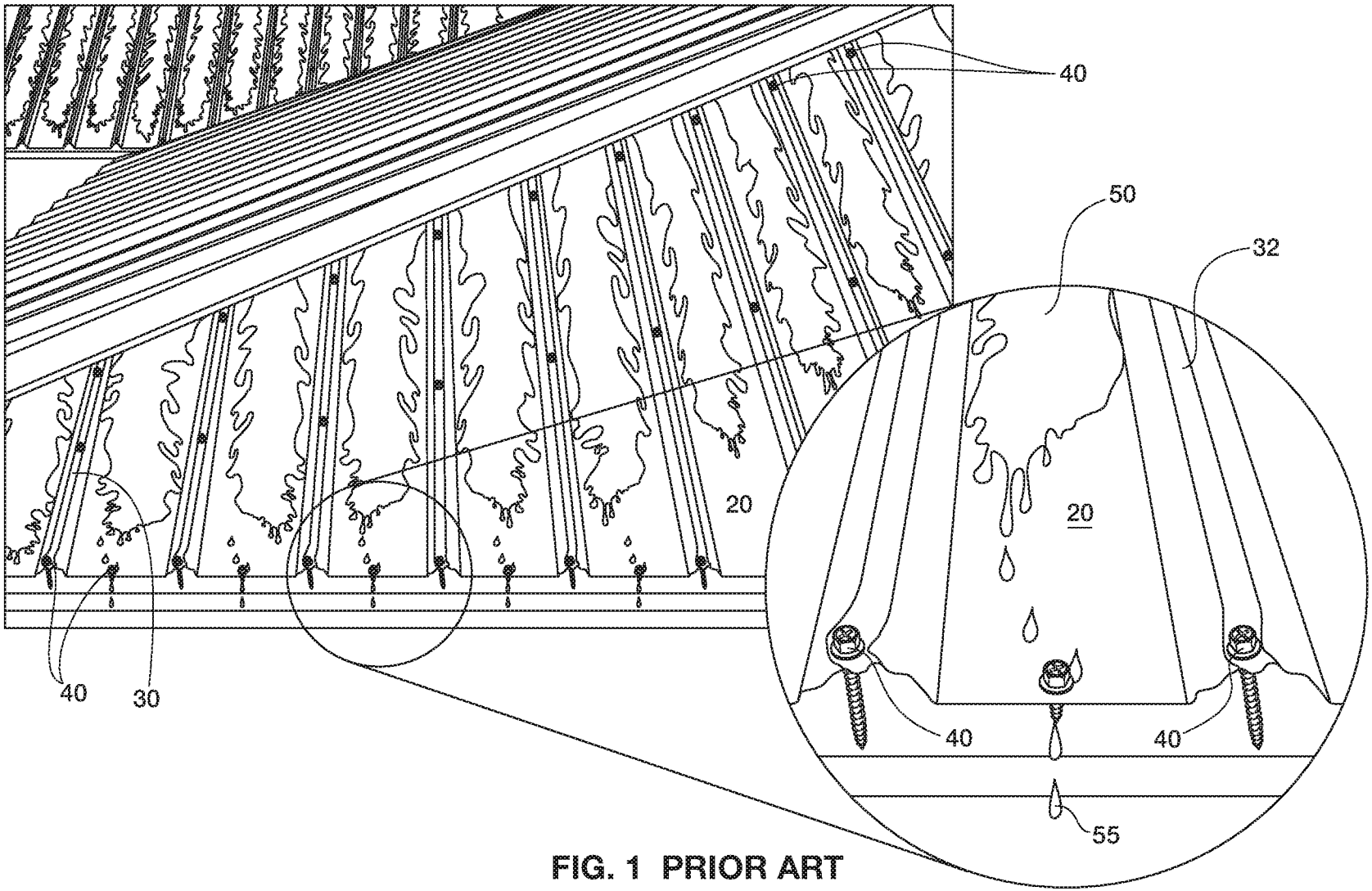
FIG. 1 PRIOR ART
FIG. 1 is a roof having known metal roof panels installed, with a panel attached at the channel and at the rib shown in an enlarged view.
Figure 2:
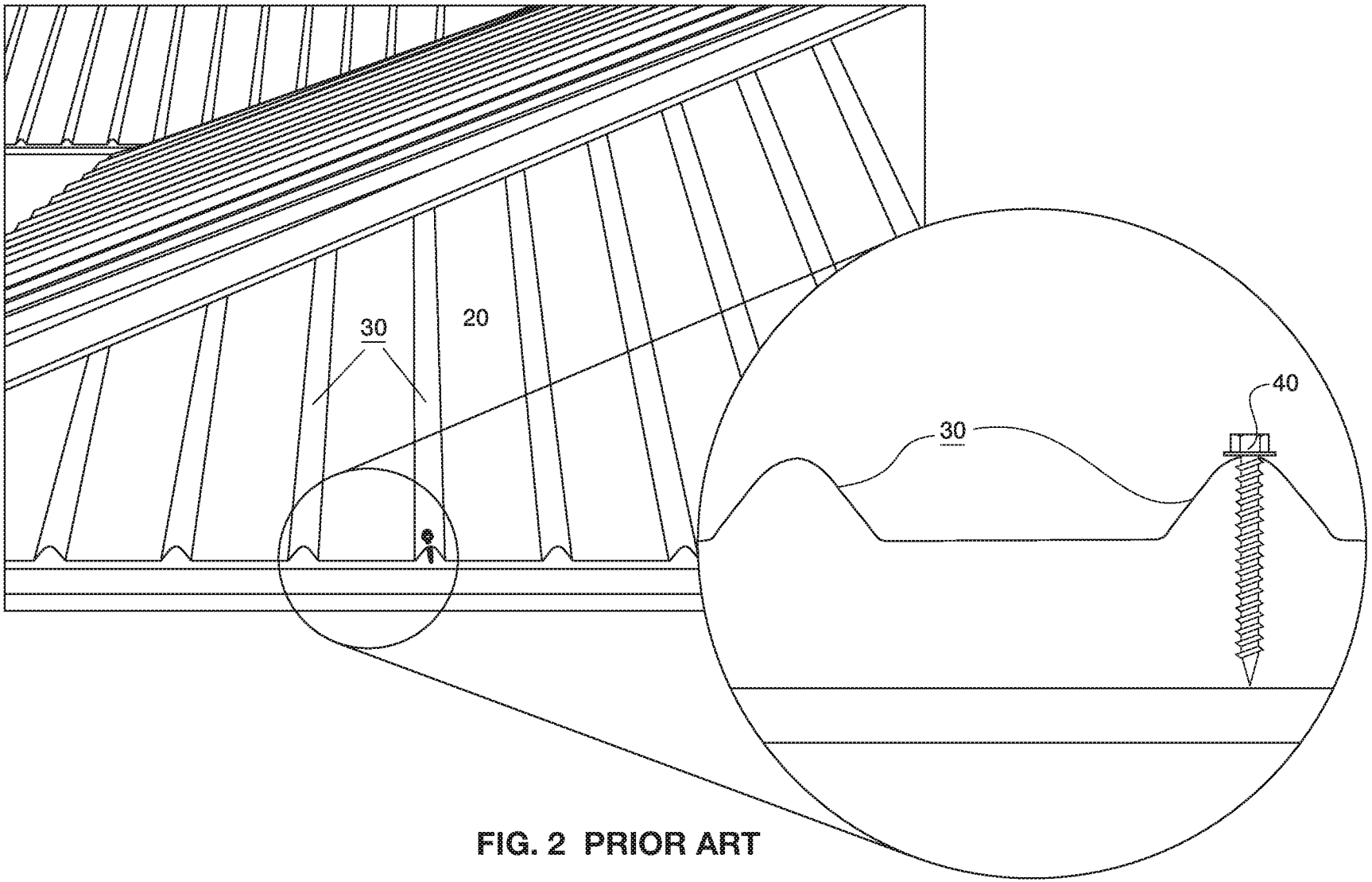
FIG. 2 PRIOR ART
FIG. 2 is a roof having known metal roof panels with rounded ribs installed, with a panel attached at the rib shown in an enlarged view.
Figure 3:
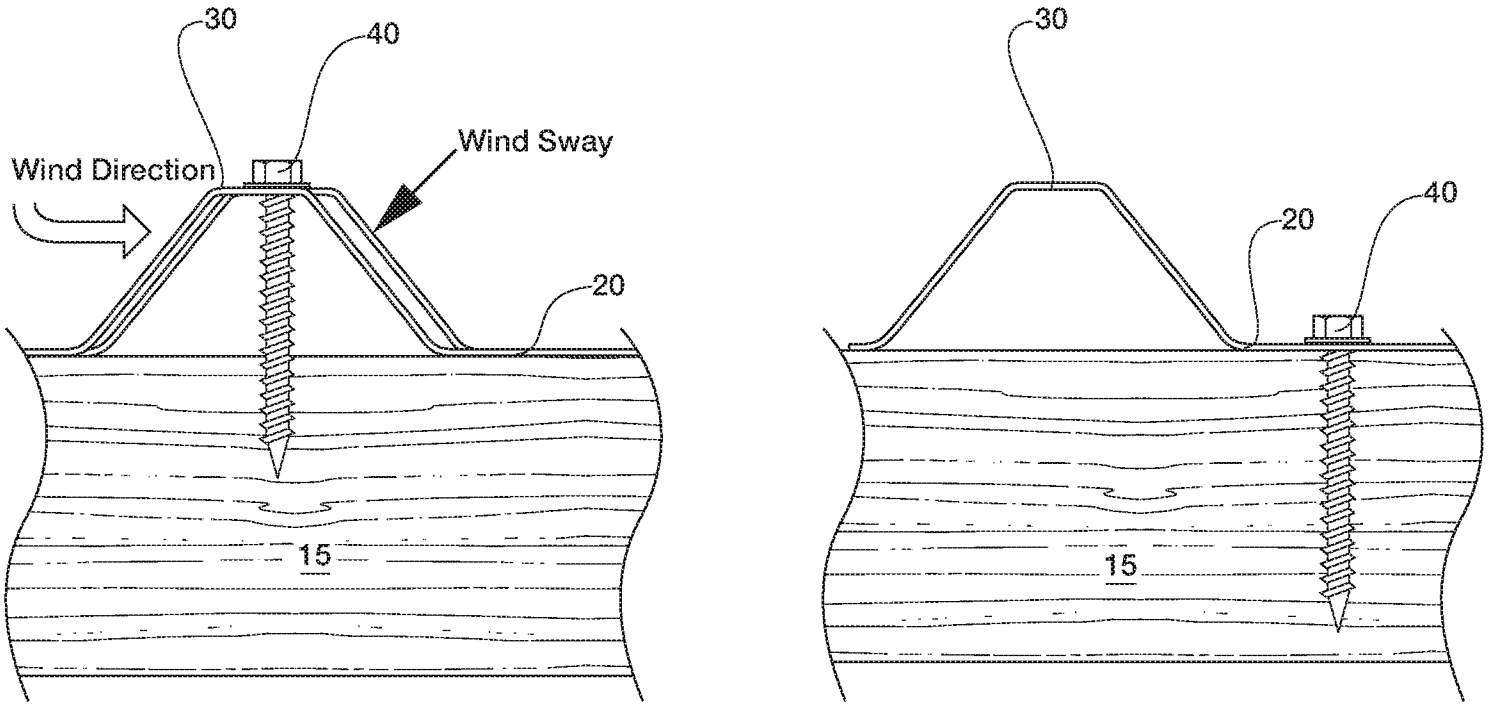
FIG. 3 PRIOR ART
FIG. 3 depicts a roof panel attached at the rib and at a channel side-by-side, with wind forces shown on the panel attached at the rib.
Figure 4:
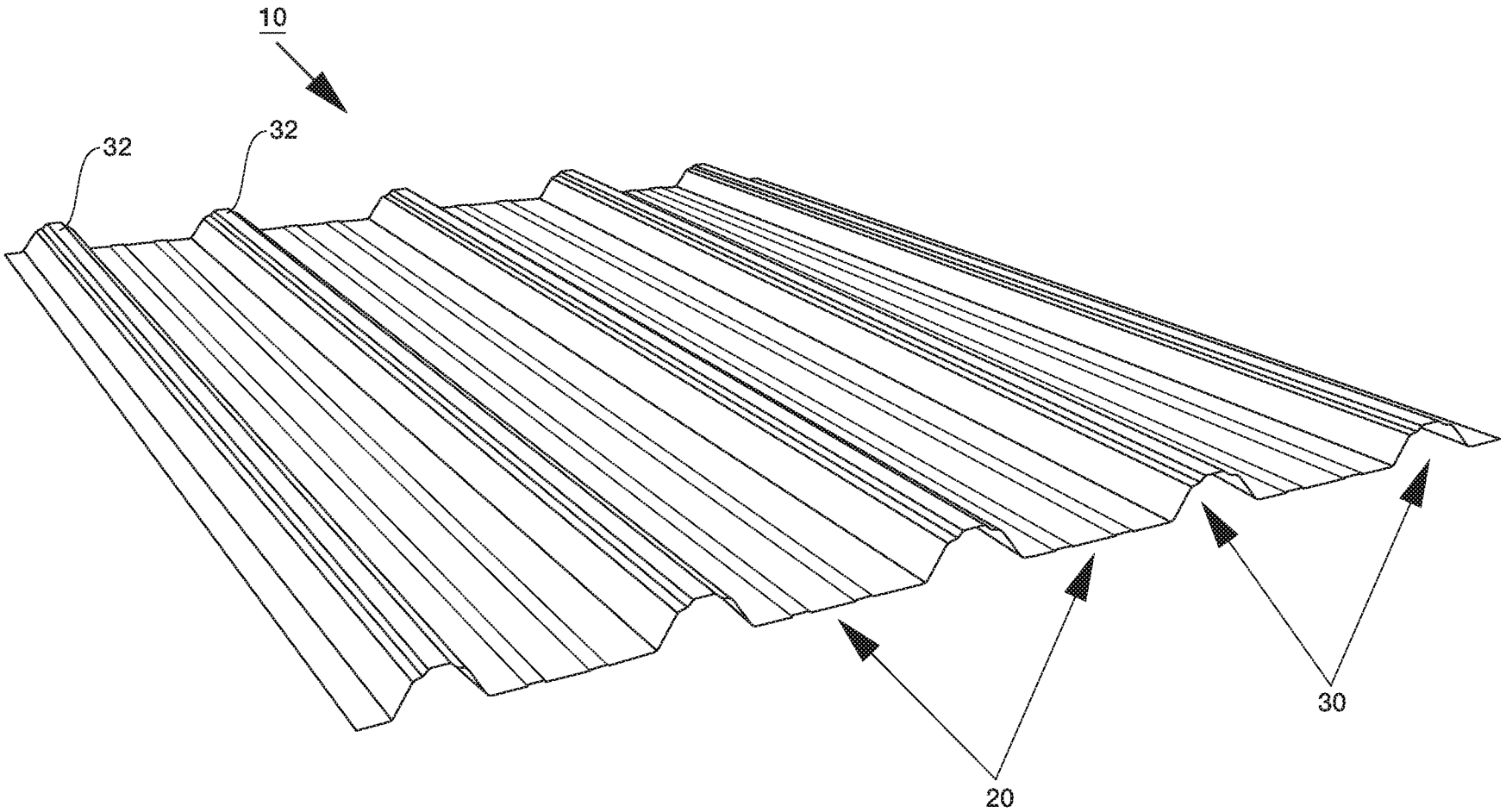
FIG. 4 is a perspective view of a roof panel of the present invention.

Referring to FIG. 4, preferred roof panel 10 preferably has a plurality of ribs 30, preferably 5, separated by a plurality of channels 20. In a preferred embodiment the roof panel can be a variety of lengths, is approximately 37⅝" wide, the distance between adjacent apices 32 is approximately 9", and the height of each rib 30 is approximately ¾", as measured from lower surface 22 (FIG. 5) to apex 32. The width of each apex 32 is preferably ⅝", which accommodates a standard screw and a standard washer. Roof panel 10 can be constructed of a variety of metals including steel, aluminum, copper, zinc, titanium, or composites including these metals. In a preferred embodiment, roof panel 10 is constructed of 29 gauge bare or pre-painted GALVALUME coil from, for example CRACO Metal Supply in York, SC.

Figure 5:
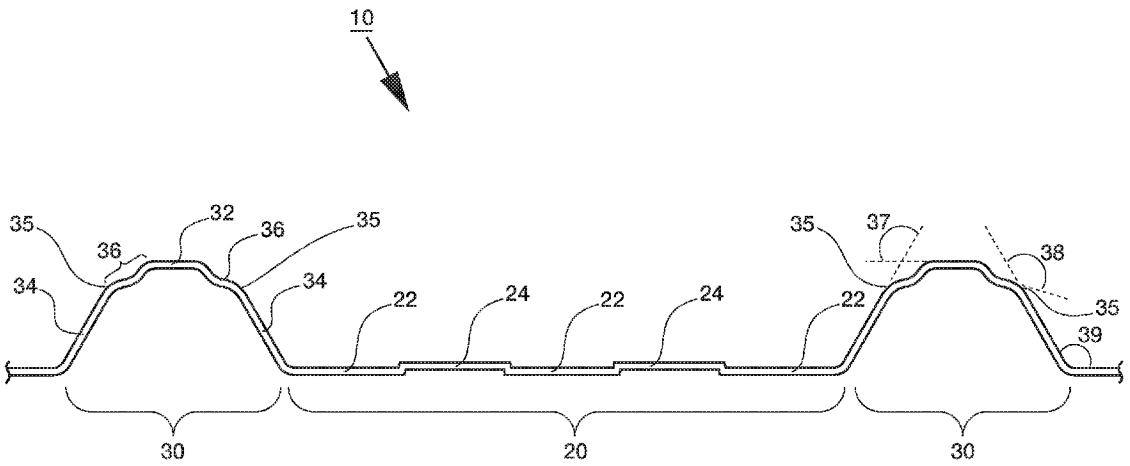
FIG. 5 is a side profile view of a section of a roof panel of the present invention.

A profile view of a section of a roof panel is depicted in FIG. 5. Each rib 30 is bilateral and preferably includes two sides 34 sloping upwardly from channels 20, one substantially flat apex 32 at the height of each rib, and a transitional indentation 36 between each side and the apex. Indentation 36 includes shoulder 35 at interface with side 34.

The rib strength of the present invention is significantly better than relevant competitors. This is an important property because it allows roof panel 10 to be screwed down tight without risking deformation. The superior rib strength of the present invention is attributed to the unique shape of the rib including indentations 36, and angles formed by intersecting planes of structures. More specifically, as shown in FIG. 5, side-apex angle 37 should be approximately 126°, side-shoulder angle 38 should be approximately 168°, and lower surface-side angle 39 should be approximately 54°.

Another benefit of the novel roof panel shape is that indentations 36 act as a water passage to the bottom of the panel and off the roof. This further eliminates standing water, likelihood of leakage, and prevents deterioration.

Figure 6:
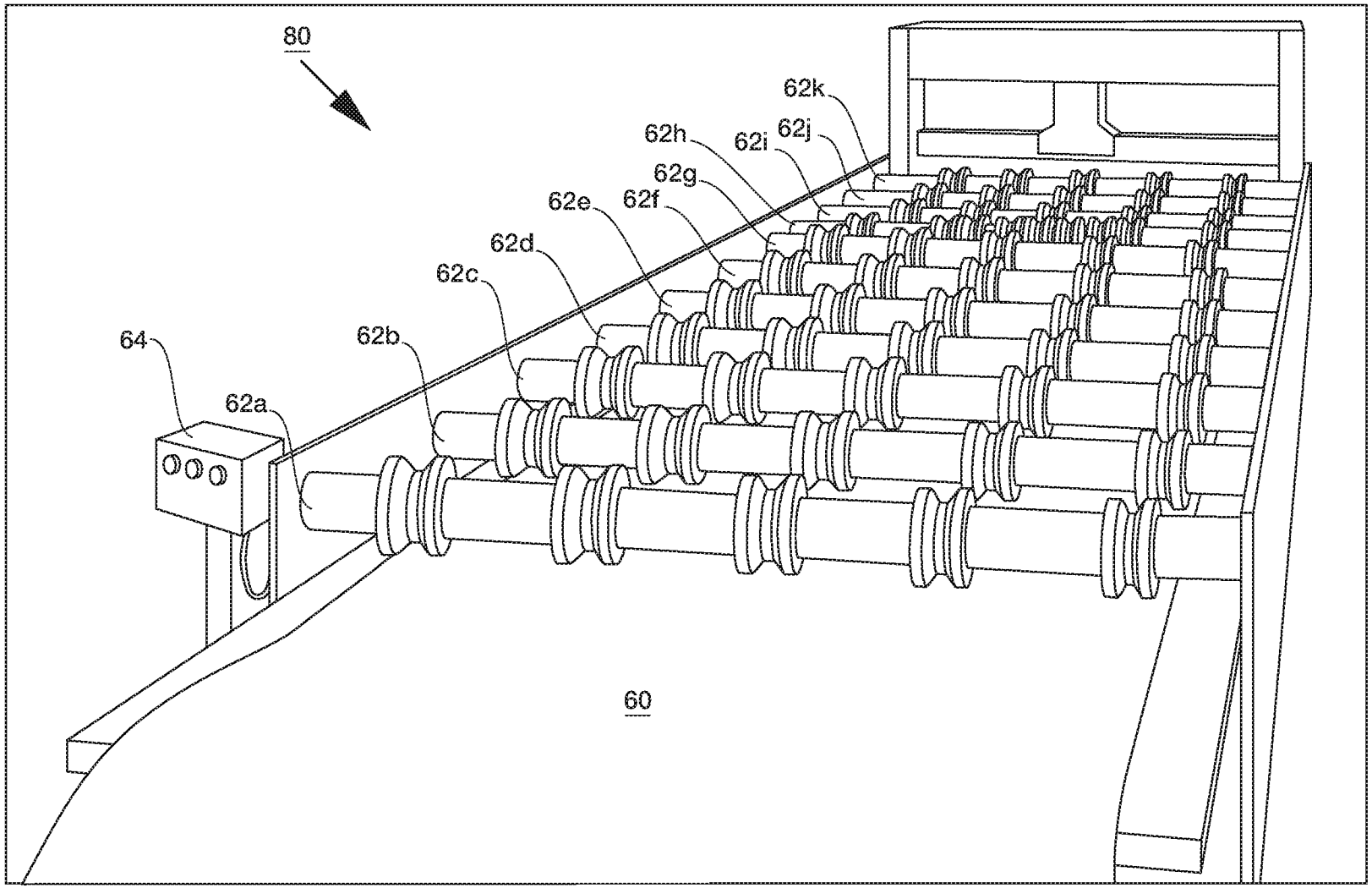
FIG. 6 is a perspective view of a roll machine.

The unique shape of the rib is possible through novel manufacturing techniques. Referring to FIG. 6, roll machine 80 preferably includes eleven set of rollers 62, with 62*a* being the first roller set, 62*b* being the second roller set, 62*c* being third roller set, and so forth. Sheet metal 60 passes through first roller set 62*a* and emerges as sheet metal post-first roller 60*a*, then passes through second roller set 62*b* and emerges as sheet metal post-second roller 60*b*, and so forth. Programmable controller 64 dictates production parameters such as roller speed, force of rollers, symmetry, and accuracy so as to keep sheet metal straight in the rollers to ensure an even run of each panel.

Figure 7:
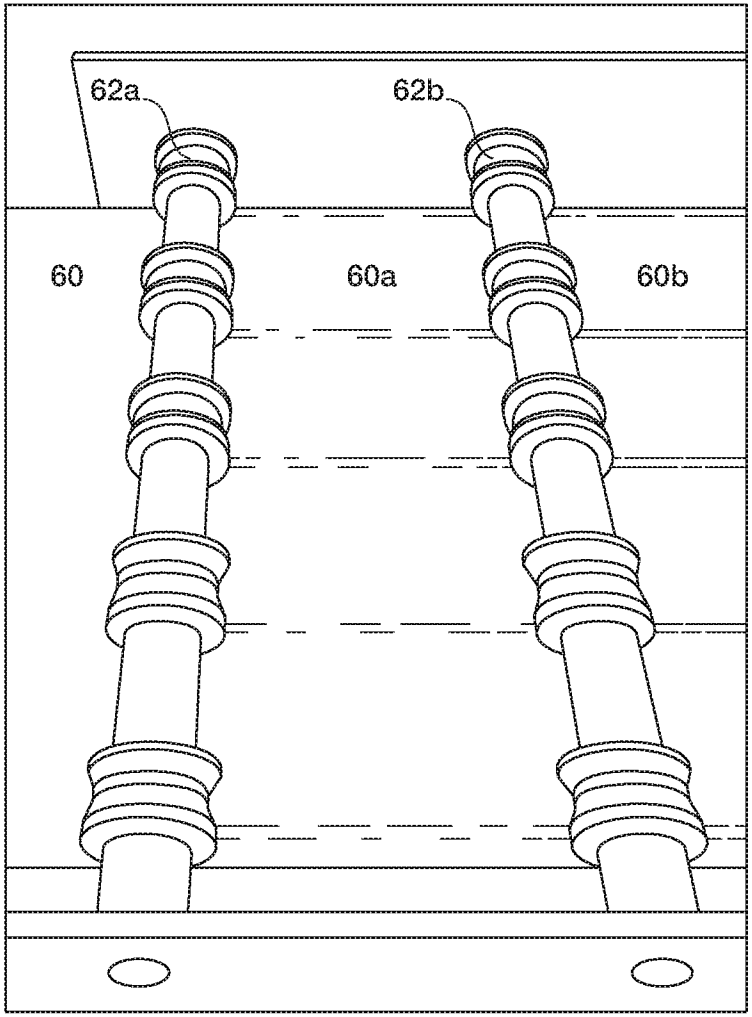
FIGS. 7-12 depict the manufacturing process with rollers forming sheet metal into a roof panel in gradual stages.
Figure 8:
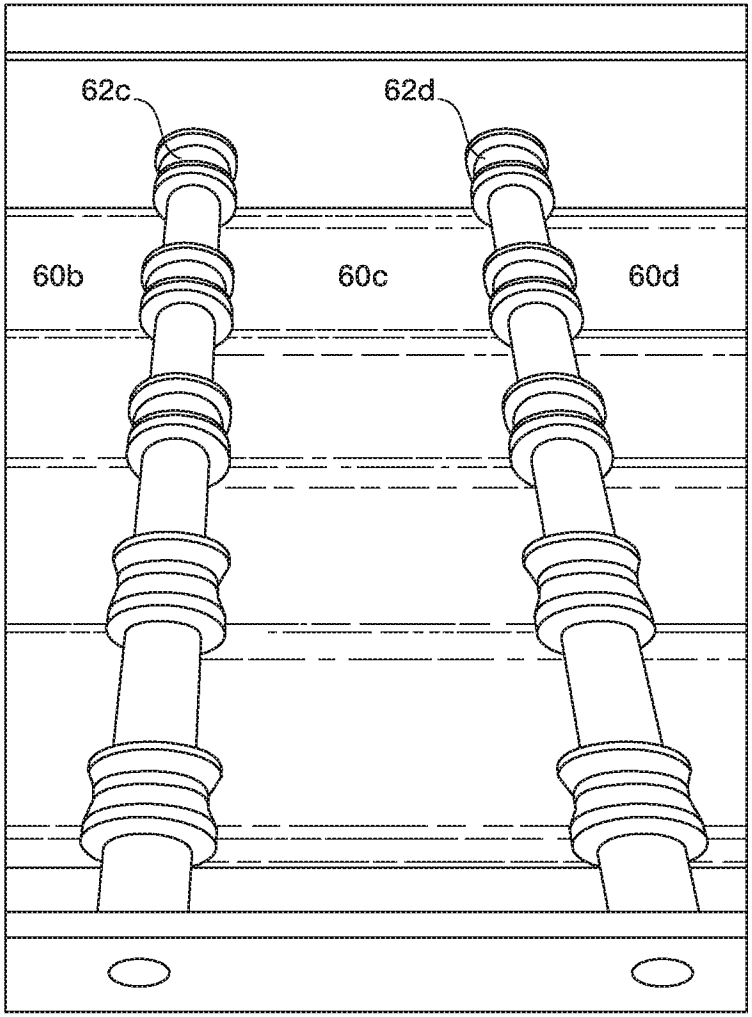
Figure 9:
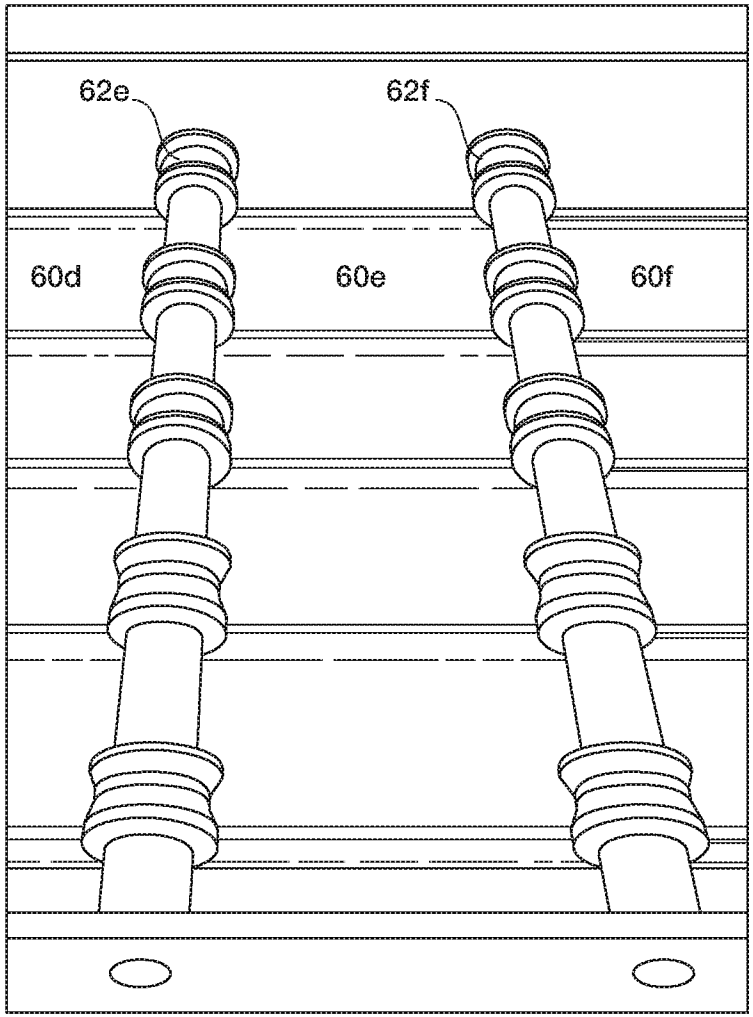
Figure 10:
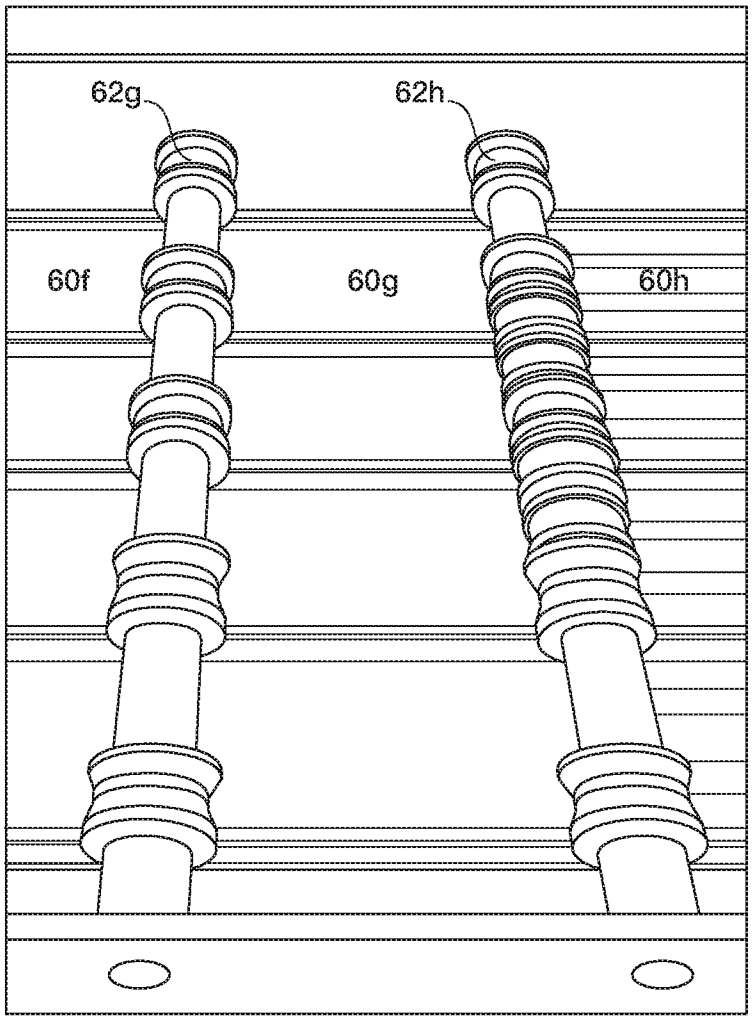
Figure 11:
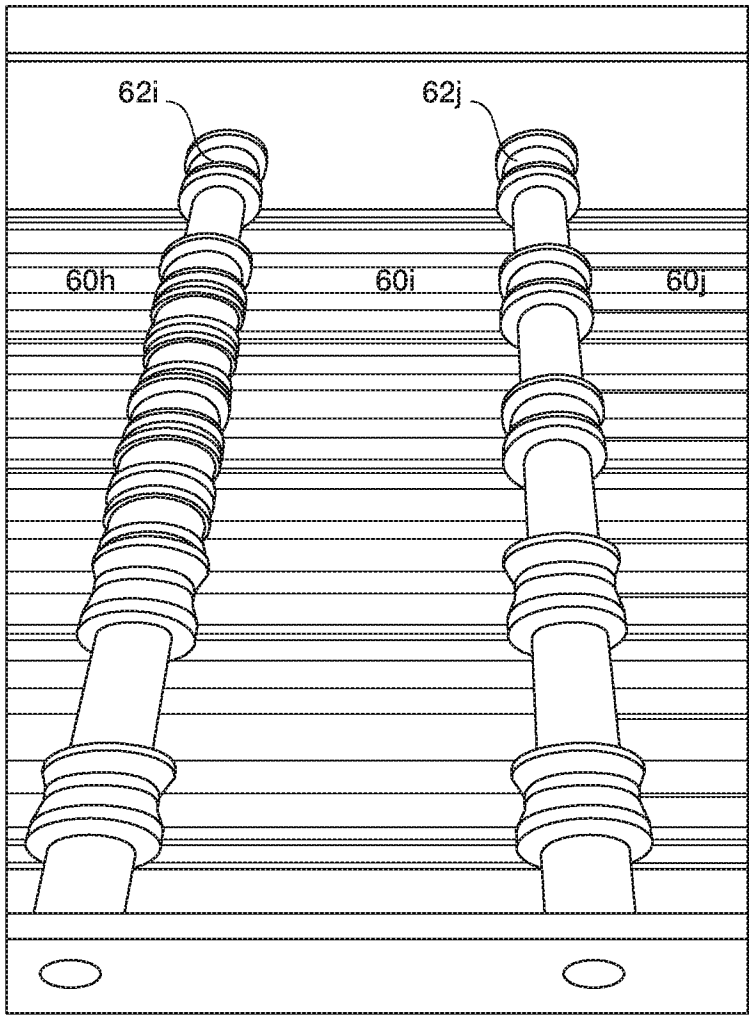
Figure 12:
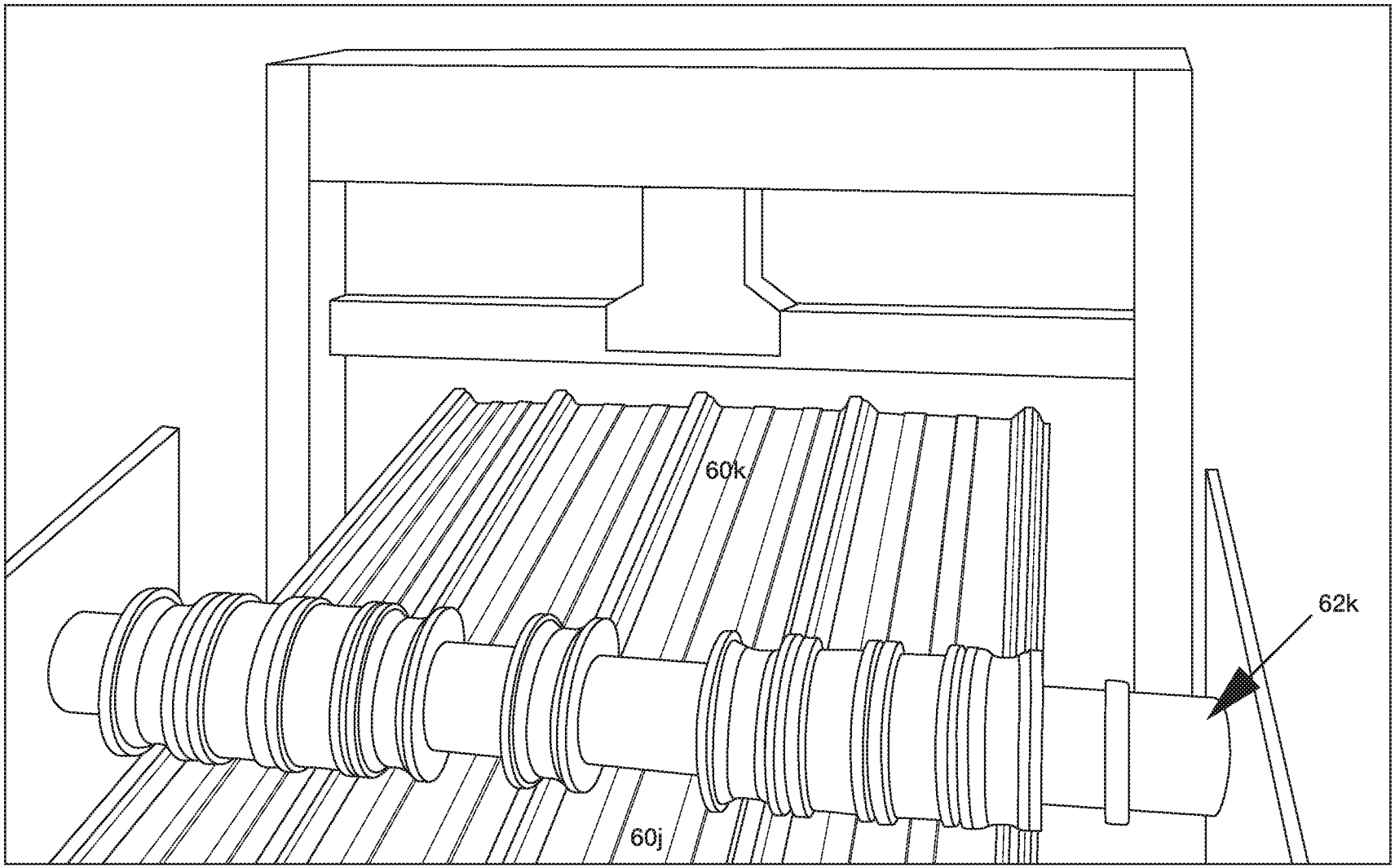
Figure 13:
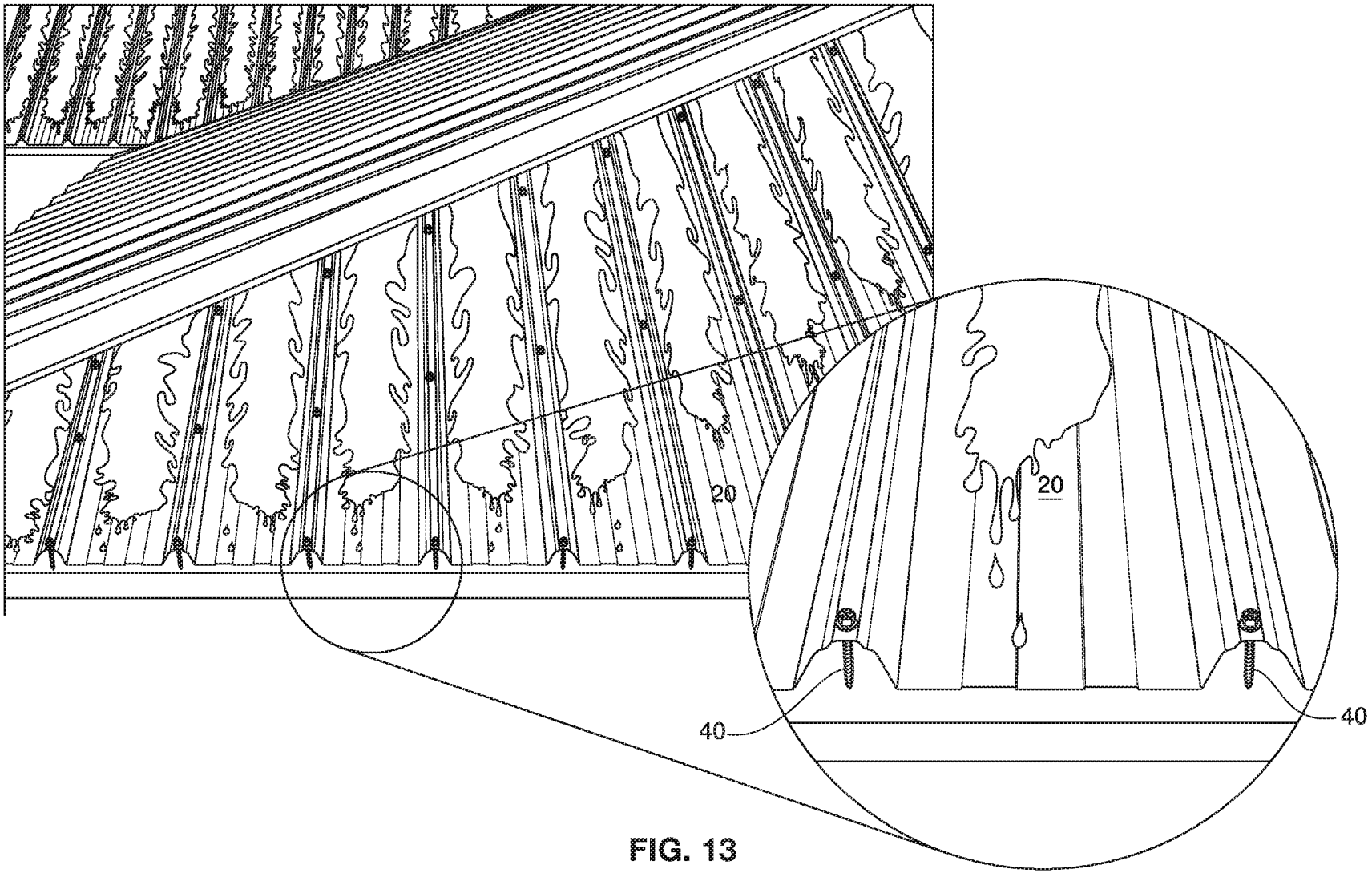
FIG. 13 is a roof having roof panels of the present invention secured along ribs.

Referring to FIG. 7, first roller set 62*a* pulls sheet 60 from a coil of sheet metal into the machine past first roller set 62*a*, which pulls slightly to the left so that the straight edge lines up on the rollers correctly. Similarly, in FIGS. 8-12 each set of rollers are different die-cuts for gradually bending the sheet to achieve the desired profile at the end.

In use, roof panels are installed in the conventional manner, except screws are used to secure the panel primarily along the ribs, and not along the lower surface 22 of channels 20. However, a minimal number of screws 40 are employed at lower surface 22 at panel bottom edges to prevent uplift.

Certain modifications and improvements will occur to those skilled in the art upon a reading of the foregoing description. It should be understood that many modifications and improvements have been omitted for the sake of conciseness and readability but are properly within the scope of the following claims. Unless stated otherwise, or contrary to common sense, all ranges include stated endpoints as well as all increments there between, however small. Also, unless stated otherwise, or contrary to common sense, all values are +/− 10%. It should also be understood that "significantly" and similar terms shall mean generally true, but allowing exceptions due to manufacturing and material variations, user variations, and so forth. By way of example, a "significantly planar" surface may have irregularities or contours.

I claim:

1. A method of installing a metal roof including the steps of:

A. positioning a roof panel on a roof, said roof panel having a profile including:

i. a plurality of bilateral ribs having upwardly angled sides that each transition into an indentation, with both indentations transitioning into a central flat apex extending from one of said indentations to the other of said indentations and having a width of approximately ⅝", wherein said ribs run substantially parallel to the slope of the roof, and wherein the angle formed between one of said upwardly angled sides and said central flat apex is approximately 126°; and ii. a plurality of channels each positioned between two of said ribs, each channel including at least one raised surface and at least one lower surface, said raised surface having a height of approximately ⅛", wherein the angle formed between one of said upwardly angled sides and said central flat apex is approximately 54°, and wherein said at least one raised surface and at least one lower surface are each substantially planar and parallel to said central flat apex; and B. attaching said roof panel to said roof with a plurality of fasteners engaged with each central flat apex wherein the resulting flat apex and fastener interface is substantially impermeable to water, wherein said roof panel is strong enough to withstand wind sway and rib deformation.

2. The method of claim 1 wherein said step of attaching said roof panel to said roof includes the step of tightening said fasteners.

3. The method of claim 2 wherein said step of tightening said fasteners includes the step of ceasing tightening prior to deformation of said roof panel.

4. The method of claim 1 wherein said step of attaching said roof panel to said roof further includes fastening at each channel with a plurality of fasteners to the roof, wherein said plurality of fasteners along each central flat apex is greater than the plurality of fasteners at each channel.

* * * * *